United States Patent [19]

Lorenzen, Jr.

[11] 4,074,637

[45] Feb. 21, 1978

[54] PILFER PROOF DISPLAY UNIT

[76] Inventor: Cornelius Lorenzen, Jr., 338 Runny Mede Road, Essex Fells, N.J. 07021

[21] Appl. No.: 675,470

[22] Filed: Apr. 9, 1976

[51] Int. Cl.[2] ..... E05G 1/10

[52] U.S. Cl. ..... 109/38; 116/75; 206/566

[58] Field of Search ..... 109/31, 38, 39, 40; 116/6, 75, 81; 206/76; 211/4, 113

[56] References Cited

U.S. PATENT DOCUMENTS

| | | | |
|---|---|---|---|
| 770,756 | 9/1904 | Hynek | 211/4 |
| 2,405,369 | 8/1946 | Poulsen et al. | 211/4 |
| 2,604,868 | 7/1952 | Shearer | 116/75 |
| 3,836,007 | 9/1974 | Rosenwein | 211/13 |

FOREIGN PATENT DOCUMENTS

| | | | |
|---|---|---|---|
| 2,204,743 | 8/1973 | Germany | 109/38 |

*Primary Examiner*—Paul R. Gilliam
*Assistant Examiner*—David H. Corbin
*Attorney, Agent, or Firm*—Kane, Dalsimer, Kane, Sullivan and Kurucz

[57] ABSTRACT

The disclosure is of a pilfer-proof display unit particularly useful for security of small articles such as rings and like jewelry while permitting a potential customer free access to the handling of the article.

5 Claims, 2 Drawing Figures

PILFER PROOF DISPLAY UNIT

BACKGROUND OF THE INVENTION

1. Field of the Invention

The invention relates to display units for displaying or merchandizing small articles such as rings and like jewelry and more specifically relates to pilfer proof display units for small articles.

2. Brief Description of the Prior Art

A merchandizer or collector of small articles inherently desires to display those articles for various purposes. Advantageously, merchandizing displays of small articles will permit a prospective customer to handle the merchandize. However, handling of small individual items poses a problem of possible theft by unscrupulous individuals. Heretofore, attempts have been made by the use of visual display cards of a relatively large size to permit a prospective purchaser to obtain a close look at the article. However, such displays restrict the prospective customer from complete handling of the article. For example, a ring may be so fastened to a display card that although the prospective purchaser may physically touch the ring, he or she is unable to place it upon a finger for viewing.

The pilfer proof display unit of this invention enables one to display small articles, such as rings, and like jewelry, in a manner enabling a prospective purchaser to handle, fit, try on, and generally use the article. However, the displayed article is firmly secured to the display unit in such a manner that its removal will actuate an alarm system to alert the displayer of the theft.

Representative of the published prior art are the disclosures found in U.S. Pat. Nos. 407,668 (1889); 777,823 (1904); 1,486,629; 1,816,598; 2,535,229; 3,002,795; 3,064,804; and 3,613,873.

SUMMARY OF THE INVENTION

The invention comprises a pilfer proof display case, which comprises;

- a housing;
- an open tray adapted to support an article for display, mounted on said housing, said tray having a display surface;
- a portal communicating between the display surface and the interior of said housing, said portal being of a dimension insufficient to permit the passage of said article;
- a line slidably mounted in said portal, said line having a first end extendable to said display surface and adapted to secure said article, said line having a second end;
- a mass of a dimension which will not permit its passage through said portal, secured to said second end and suspended within the space defined by said housing;
- an audible alarm, activatable upon removal of the line connection between said mass and said article.

The term "line" as used throughout the specification and claims is used to mean a flexible cord, rope, string, wire, monofilament, cable and the like.

DETAILED DESCRIPTION OF THE PREFERRED EMBODIMENTS

Figure 1:
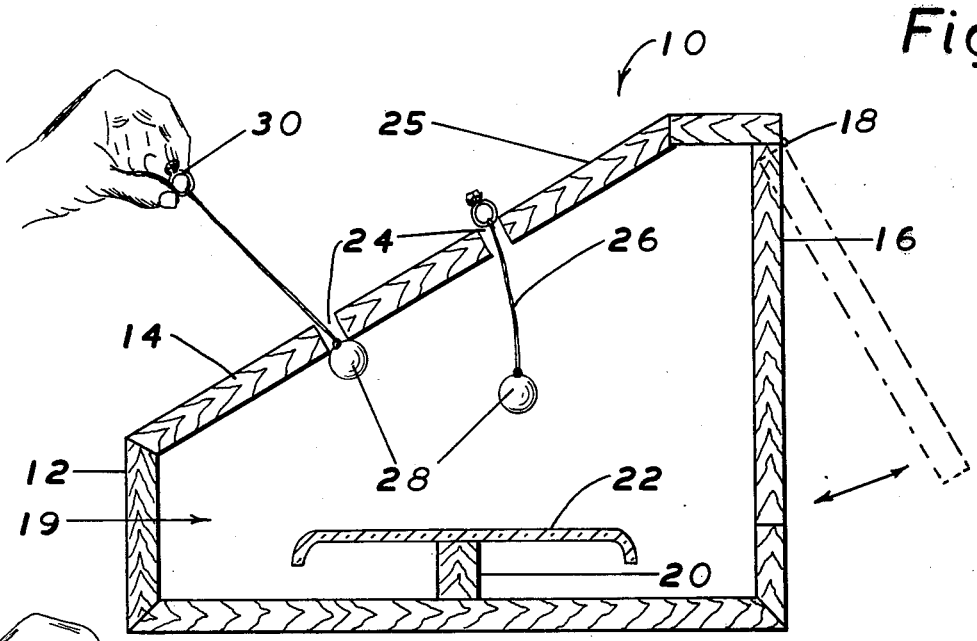
FIG. 1 is a cross sectional side elevation of an embodiment unit of the invention.
Figure 2:
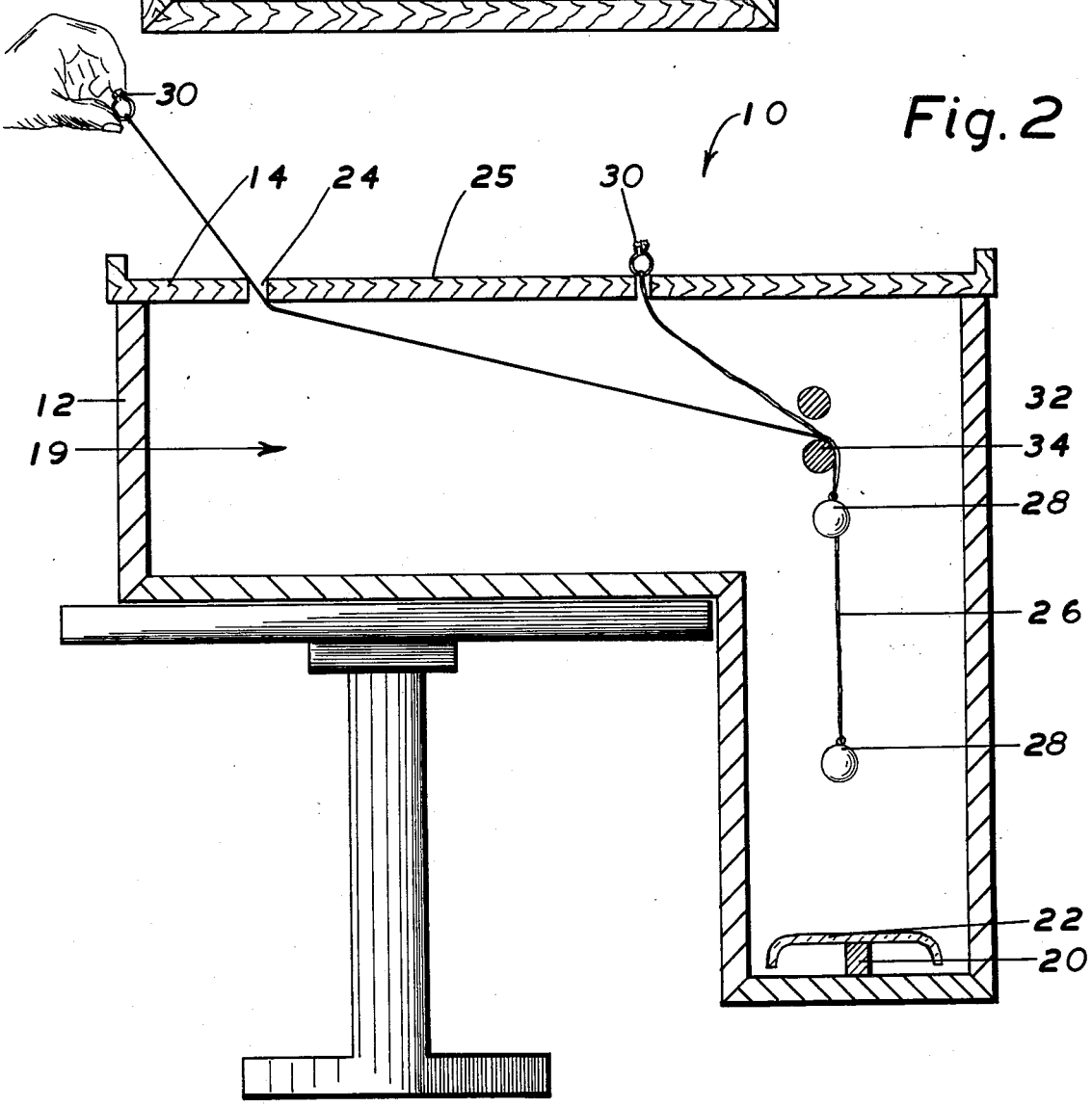
FIG. 2 is a cross sectional side elevation of an alternate embodiment of the invention.

A complete understanding of the invention may be readily obtained by referring to the accompanying drawings of FIGS. 1 and 2 in conjunction with the following description.

FIG. 1 is a cross sectional side elevation of an embodiment display unit 10 of the invention. Unit 10 comprises a housing 12 including as an upper surface a display tray 14. An access door 16 is secured by hinge 18 to one end of the display tray 14 to complete an enclosure of space 19 which is the interior of the housing. Mounted on post 20 within space 19 is a bell 22. Bell 22 is positioned directly beneath portals 24 which communicate between the display surface 25 and space 19. Passing through portals 24 are lines 26. Lines 26 may be any flexible cord, wire, rope, string, monofilament, or like flexible attaching line. Preferably, line 26 is a cable, most preferably of flexible steel. Line 26 is slidably mounted in portal 24 with a first end attached to a small article 30 for display on display surface 25. The first end of line 26 is adapted to be securely fastened to the article 30 so that detachment requires severing of the article 30 or line 26. The second end of line 26 is attached to a mass 28, preferably a heavy metal weight. The portals 24 should be of a dimension which permits the sliding of cable 26 therethrough, but denies passage of article 30 or mass 28. The length of line 26 should be sufficient to permit a prospective purchaser to move article 30 off display surface 25 (as shown in the drawing) for close examination. The length of line 26 should be such that mass 28 is suspended in space 19 above bell 22. In operation, the housing is enclosed or constructed so that one cannot simultaneously hold an article 30 and reach mass 28. With such a construction, a prospective thief, should he sever the connection between line 26 and article 30 will release mass 28 so that it falls upon bell 22 and provides an audible alarm to alert personnel to the fact that article 30 has been removed from display surface 25 in an unauthorized manner. When line 26 has not been detached from article 30, the structure of unit 10 is such that upon release by the prospective customer, article 30 will always be returned to its assigned position on display surface 25. This is because mass 28 will serve to snub article 30 against display surface 25 in its normal position.

Referring now to FIG. 2, an alternate embodiment unit 30 of the invention may be observed wherein the same numeric symbols have been assigned for structures analagous to those found in the embodiment 10 of FIG. 1. The embodiment 30 of FIG. 2 differs from embodiment 10 shown in FIG. 1 in that unit 30 is specifically designed for mounting on a counter. The unit 30 also provides a means for extending the drop distance between mass 28 and bell 22 upon unauthorized detachment of line 26 from an article 30. As shown, guide means 32 and 34, which are bars traversing space 19, guide the lines 26 into position over bell 22 which is in a lower extension of housing 12. The operation of unit 30 is essentially the same as that described above in relation to unit 10 of FIG. 1. A similar system, i.e.; employing guide means 32, 34 to direct mass 28 over a particular zone is particularly useful for a wall mounted unit wherein display surface 25 would be vertical.

Those skilled in the art will recognize that although the embodiments described above are relatively simple, many modifications may be made thereto without departing from the spirit of the invention. For example, the bell 22 may be replaced with a more sophisticated alarm system activated by the fall of mass 28. For example, line 26 may also be secured to an electrical switch which activates an electrical alarm system for continuous alarm sounding when mass 28 falls beyond its normal low position. For a further example, line 26 may be an integral part of an electrical system, severance of which activates a conventional alarm system. As further examples, the housing 12 may take on any desired shape, display tray 25 may be made more sophisticated and may be a separate but associated component, associated with housing 12.

What is claimed:

1. A pilfer proof display case, which comprises;

a housing including sidewalls and a bottom wall;

an open tray adapted to support an article for display, mounted on said housing, said tray having a display surface;

a portal communicating between the display surface and the interior of said housing;

said portal being of a dimension insufficient to permit the passage of said articles;

a flexible line slidably mounted in said portal, said line having a first end extendable beyond said display surface and outside of said housing and adapted to secure said article, said flexible line having a second end within the interior of said housing;

a mass of dimension which will not permit its passage through said portal, connected to said second end, said mass being positioned within said housing so as to be free of impinging with the sidewalls thereof;

an audible alarm, mounted on said housing beneath said mass, said alarm being activatable by being struck by said mass, which occurs upon the release of said mass by removal of the connection between said mass and said article.

2. The case of claim 1 wherein said line is a cable.

3. The case of claim 2 wherein said cable is a metallic cable.

4. The case of claim 1 wherein said alarm is a bell.

5. The case of claim 1 wherein said tray is an integral part of said housing.

* * * * *